US009243523B2

(12) United States Patent
Noguchi et al.

(10) Patent No.: US 9,243,523 B2
(45) Date of Patent: Jan. 26, 2016

(54) VALVE TIMING CONTROL DEVICE

(71) Applicant: AISIN SEIKI KABUSHIKI KAISHA, Kariya-shi (JP)

(72) Inventors: Yuji Noguchi, Kariya (JP); Kazunari Adachi, Kariya (JP); Hideyuki Suganuma, Kariya (JP); Shinji Oe, Kariya (JP); Takeo Asahi, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 14/355,496

(22) PCT Filed: Dec. 21, 2012

(86) PCT No.: PCT/JP2012/083205

§ 371 (c)(1),
(2) Date: Apr. 30, 2014

(87) PCT Pub. No.: WO2013/108544

PCT Pub. Date: Jul. 25, 2013

(65) Prior Publication Data

US 2015/0027393 A1 Jan. 29, 2015

(30) Foreign Application Priority Data

Jan. 16, 2012 (JP) ..... 2012-006458

(51) Int. Cl.
*F01L 1/34* (2006.01)
*F01L 1/356* (2006.01)

(52) U.S. Cl.
CPC ..... *F01L 1/356* (2013.01)

(58) Field of Classification Search
CPC ..... F01L 1/356
USPC ..... 123/90.17
See application file for complete search history.

(56) References Cited

U.S. PATENT DOCUMENTS 5,823,152 A 10/1998 Ushida
5,832,887 A 11/1998 Adachi et al.

(Continued)

FOREIGN PATENT DOCUMENTS

JP 2000-002105 A 1/2000
JP 2000-230511 A 8/2000

(Continued)

OTHER PUBLICATIONS

Notification of Transmittal of Copies of Translation of the International Preliminary Report on Patentability (Forms PCT/IB/338 and PCT/IB/373) and the Written Opinion of the International Search Authority (Form PCT/ISA/237) issued on Aug. 13, 2014, by the International Bureau of WIPO in corresponding International Application No. PCT/JP2012/083205. (7 pages).

(Continued)

*Primary Examiner* — Zelalem Eshete
(74) *Attorney, Agent, or Firm* — Buchanan Ingersoll & Rooney PC

(57) ABSTRACT

A valve timing control device includes a lock mechanism having a hole portion formed in one of the driving-side/driven-side rotational members, a sleeve in the hole portion, a lock member in the sleeve and capable of projecting and retracting with respect to the other of the driving-side/driven-side members, and a lock hole formed in the other of the driving-side/driven-side members such that the lock member can be fitted to the lock hole when the lock member projects. The lock mechanism constrains a relative rotational phase of the driven-side rotational member with respect to the driving-side rotational member at a predetermined phase when the lock member is fitted to the lock hole. A first chamfered surface is formed in the circumferential direction at an inner-circumferential corner of an end of the sleeve on the side opposite to the side facing the lock hole.

4 Claims, 5 Drawing Sheets

(56) References Cited

U.S. PATENT DOCUMENTS

| | | | | |
|---|---|---|---|---|
| 5,960,757 | A | 10/1999 | Ushida | |
| 6,006,709 | A | 12/1999 | Ushida | |
| 6,155,221 | A | 12/2000 | Ushida | |
| 6,199,524 | B1 | 3/2001 | Ushida | |
| 6,439,182 | B1 * | 8/2002 | Sugiura et al. | 123/90.17 |
| 2001/0039932 | A1 | 11/2001 | Sekiya et al. | |
| 2002/0040697 | A1 | 4/2002 | Sugiura et al. | |
| 2002/0129781 | A1 | 9/2002 | Kinugawa | |

FOREIGN PATENT DOCUMENTS

| | | | |
|---|---|---|---|
| JP | 2002-180808 | A | 6/2002 |
| JP | 2011-214563 | A | 10/2011 |

OTHER PUBLICATIONS

Notification of Transmittal of Copies of Translation of the International Preliminary Report on Patentability (Forms PCT/IB/338 and PCT/IB/373) and the Written Opinion of the International Search Authority (Form PCT/ISA/237) issued on Aug. 13, 2014, by the International Bureau of Wipo in corresponding International Application No. PCT/JP2012/08205. (7 pages).

International Search Report (PCT/ISA/210) mailed on Mar. 19, 2013, by the Japanese Patent Office as the International Searching Authority for International Application No. PCT/JP2012/083205.

Written Opinion (PCT/ISA/237) mailed on Mar. 19, 2013, by the Japanese Patent Office as the International Searching Authority for International Application No. PCT/JP2012/083205.

* cited by examiner

VALVE TIMING CONTROL DEVICE

TECHNICAL FIELD

The present invention relates to a valve timing control device for controlling a relative rotational phase of a driven-side rotational member with respect to a driving-side rotational member that rotates synchronously with a crankshaft in an internal combustion engine.

BACKGROUND ART

Conventionally, valve timing control devices have been known that control a relative rotational phase between a driving-side rotational member rotating synchronously with a crankshaft in an internal combustion engine and a driven-side rotational member rotating synchronously with a camshaft for opening and closing a valve, and keep an excellent running state of the internal combustion engine at every number of revolutions. In a valve timing control device, a fluid pressure chamber formed by the driving-side rotational member and the driven-side rotational member is partitioned into a retard chamber and an advance chamber by a partitioning portion provided in the driven-side rotational member. The relative rotational phase between the driving-side rotational member and the driven-side rotational member is controlled by supplying and discharging a working fluid to and from the retard chamber and the advance chamber.

This valve timing control device includes a lock mechanism capable of locking the relative rotational phase between the driving-side rotational member and the driven-side rotational member at a predetermined phase. As a result of locking the relative rotational phase, an optimum valve opening/closing timing can be achieved when the internal combustion engine is started, and generation of collision noise caused by swinging of the partitioning portion is suppressed.

An exemplary lock mechanism includes a lock hole in one of the driving-side rotational member and the driven-side rotational member, and includes a lock member and a coil spring for applying a biasing force to the lock member in the other of the driving-side rotational member and the driven-side rotational member. With this lock mechanism, a locked state is achieved by inserting the lock member in the lock hole by means of the biasing force, and an unlocked state is achieved by retracting the lock member from the lock hole by means of the pressure of the working fluid that is larger than the biasing force.

PTL 1 discloses a valve timing adjustment device capable of reducing a linking force generated when the locking pin is operating so as to be fitted to a fitting hole. A linking force refers to a force generated when two objects in contact with each other with a fluid therebetween are about to move apart from each other, in directions opposite to the directions in which the objects move away from each other, due to an increase in the volume of the fluid between the contact surfaces and a reduction in the pressure in the gap therebetween.

An end of the locking pin on the side opposite to the fitting hole side is usually a flat surface, and the flat surface at the end of the locking pin comes into surface contact with a front plate when in an unlocked state. At this time, the working fluid leaking from the advance chamber or the retard chamber is present as a fluid film between the end of the locking pin and the front plate. If the locking pin in this state begins to move in the fitting direction as a result of a locking operation, in some cases, the linking force is generated due to this fluid film, in the direction opposite to the direction of the biasing force of the coil spring exerted on the locking pin.

If the linking force is large, an initial operation of the locking pin delays, and the locking pin is not fitted to the fitting hole in some cases. As a result, there is a possibility that the relative rotational phase between the driving-side rotational member and the driven-side rotational member cannot be locked at the predetermined phase, and the internal combustion engine cannot be started. In order to reduce the linking force, it is effective to reduce the area of the fluid film, and prevent a decrease in the pressure with an expansion of a gap between the end of the locking pin and the front plate as a result of the working fluid actively entering the gap when the locking pin moves in the fitting direction.

The valve timing adjustment device in PTL 1 is configured such that the end surface of the locking pin on the side opposite to the fitting hole is tapered and comes into line contact with the front plate. Since the end surface of the locking pin and the front plate are in line contact, the area of the fluid film is reduced. Furthermore, a space between the end surface of the locking pin and the front plate at portions other than the portion in line contact is filled with the working fluid. When the locking pin begins to move in the fitting direction and the gap expands, the working fluid around the gap enters the gap and prevents the reduction in the pressure in the gap. As a result, the linking force at the time when the locking pin begins to move in the fitting direction is reduced.

CITATION LIST

Patent Literature

PTL 1: JP2011-214563 A

SUMMARY OF INVENTION

Technical Problem

When the locking pin retracts from the fitting hole and the unlocked state is achieved, the end surface of the locking pin and the front plate come into contact with each other. Since the end surface of the locking pin and the front plate are in line contact in the valve timing adjustment device in PTL 1, if the end surface of the locking pin and the front plate are repeatedly brought into contact, a deformation or abrasion may possibly occur at a tip of the tapered shape of the end surface of the locking pin in line contact with the front plate. In the case where a deformation or abrasion occurs unevenly, there is a possibility that the locking pin in the unlocked state comes into biased contact with the front plate and is inclined, and the locking pin cannot operate smoothly at the time of projecting and retracting operations as a result of rubbing the surrounding wall surfaces or the like.

In view of the foregoing problem, an object of the present invention is to provide a valve timing control device that includes a projecting and retracting mechanism having high abrasion resistance and capable of reducing the linking force.

Solution to Problem

To achieve the above-stated object, the characteristic configuration of a valve timing control device according to the present invention lies in that the opening/closing timing control device includes: a driving-side rotational member rotating synchronously with a crankshaft in an internal combustion engine; a driven-side rotational member disposed coaxially with the driving-side rotational member and rotating synchronously with a camshaft for opening and closing a valve in the internal combustion engine; a fluid pressure chamber formed by the driving-side rotational member and the driven-side rotational member; a partitioning portion provided in at least one of the driving-side rotational member and the driven-side rotational member so as to partition the fluid pressure chamber into an advance chamber and a retard chamber; and a projecting and retracting mechanism having a hole portion formed in one of the driving-side rotational member and the driven-side rotational member, a cylindrical sleeve accommodated in the hole portion, a projecting and retracting member accommodated in the sleeve and capable of projecting and retracting with respect to the other of the driving-side rotational member and the driven-side rotational member, and a fitting hole formed in the other of the driving-side rotational member and the driven-side rotational member such that the projecting and retracting member can be fitted to the fitting hole when the projecting and retracting member projects, the projecting and retracting mechanism constraining a relative rotational phase of the driven-side rotational member with respect to the driving-side rotational member at a predetermined phase when the projecting and retracting member is fitted to the fitting hole, wherein when the projecting and retracting member retracts from the fitting hole, an end face of the projecting and retracting member on a side opposite to a side facing the fitting hole comes into surface contact with a bottom surface of the hole portion, and a first chamfered surface is formed in a circumferential direction at an inner-circumferential corner of an end of the sleeve on a side opposite to a side facing the fitting hole.

With this characteristic configuration, the end surface of the projecting and retracting member on the side opposite to the side facing the fitting hole comes into surface contact with the bottom surface of the hole portion when in an unlocked or unconstrained state, and accordingly a deformation or abrasion does not occur even if the end surface of the projecting and retracting member and the bottom surface of the hole portion are repeatedly brought into contact, and the valve timing control device can maintain excellent performance for a long period of time.

Furthermore, since the first chamfered surface is formed in the circumferential direction at an inner-circumferential corner of an end of the sleeve on the side opposite to the side facing the fitting hole, a ring-like space constituted by the first chamfered surface, the bottom surface of the hole portion, and the outer-circumferential surface of the projecting and retracting member is filled with the working fluid when in the unlocked or unconstrained state. With this configuration, when the projecting and retracting member begins to move from the unlocked or unconstrained state to a locked or constrained state, the working fluid remaining in the ring-like space flows into a gap between the end face of the projecting and retracting member on the side opposite to the side facing the fitting hole and the bottom surface of the hole portion, even if this gap increases. As a result, the pressure of the fluid film of the working fluid that is present between the end surface of the projecting and retracting member on the side opposite to the side facing the fitting hole and the bottom surface of the hole portion does not decrease, and accordingly, generation of the linking force can be reduced.

In the valve timing control device according to the present invention, it is preferable that a plurality of first chamfered surfaces are formed dispersedly in the circumferential direction.

With this configuration, the working fluid can be reserved in the space where the first chamfered surface is formed, and the projecting and retracting member can be retained at portions other than the first chamfered surface. Accordingly, both a reduction in the linking force and a stable operation of the projecting and retracting member can be achieved by forming the first chamfered surface that is sufficient for reserving a minimum necessary amount of the working fluid for reducing the linking force.

In the valve timing control device according to the present invention, it is preferable that a second chamfered surface is formed in a circumferential direction at an outer-circumferential corner of an end of the projecting and retracting member on a side opposite to a side facing the fitting hole.

With this configuration, a ring-like space is constituted by the first chamfered surface, the bottom surface of the hole portion, and the second chamfered surface when in the unlocked or unconstrained state, and accordingly a ring-like space having a larger volume can be obtained, and a larger amount of the working fluid can be reserved in the ring-like space. Thus, generation of the linking force can further be reduced.

In the valve timing control device according to the present invention, it is preferable that the sleeve is configured in a shape formed by concentrically stacking a first hole and a second hole whose diameter is smaller than the diameter of the first hole, on an inner-circumferential side of the sleeve, the projecting and retracting member has, on an outer-circumferential side thereof, a first shaft portion whose outer diameter is smaller than the inner diameter of the first hole, and a second shaft portion whose outer diameter is smaller than the inner diameter of the second hole, the inner circumference of the first hole faces the outer circumference of the first shaft portion, and the inner circumference of the second hole faces the outer circumference of the second shaft portion, in a state where the projecting and retracting member is accommodated in the sleeve, and a gap between the first hole and the first shaft portion is smaller than a gap between the second hole and the second shaft portion.

With this configuration, the working fluid reserved in the space formed by the first hole and the second shaft portion when the projecting and retracting member retracts from the fitting hole flows into the gap between the second hole and the second shaft portion when the projecting and retracting member projects toward the fitting hole, and accordingly, a part of sliding surfaces of the projecting and retracting member and the sleeve can be lubricated.

DESCRIPTION OF EMBODIMENTS

Hereinafter, an embodiment of a valve timing control device of the present invention applied, as a valve timing control device 1 provided on an intake valve side, to an automobile engine 100 will be described based on FIGS. 1 to 8. Note that the "engine" has the same meaning as that of an "internal combustion engine" in the scope of claims.

Overall Configuration

Figure 1:
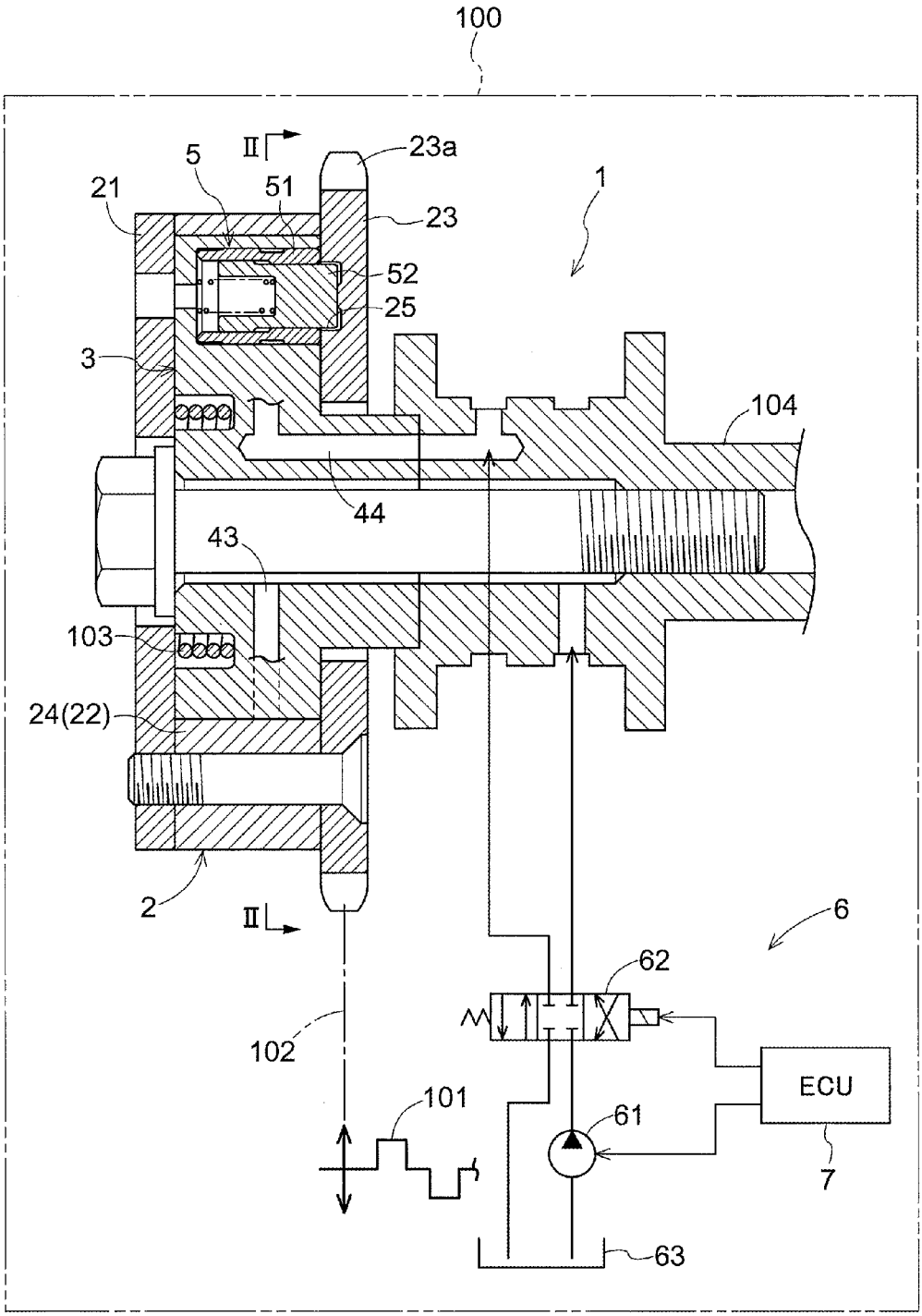
FIG. 1 is a cross-sectional side view showing an overall configuration of a valve timing control device.

FIG. 1 shows a cross-sectional side view showing an overall configuration of a valve timing control device 1 according to the present embodiment. As shown in FIG. 1, the valve timing control device 1 includes a housing 2 serving as a driving-side rotational member that rotates synchronously with a crankshaft 101 in an engine 100, and an internal rotor 3 serving as a driven-side rotational member that is disposed coaxially with the housing 2 and rotates synchronously with a camshaft 104. The housing 2 and the internal rotor 3 are made of metal such as aluminum alloy. The camshaft 104 is a rotary shaft of cams (not shown) for controlling opening and closing of exhaust valves in the engine. The valve timing control device 1 includes a lock mechanism 5 capable of constraining the relative rotational phase of the internal rotor 3 with respect to the housing 2 at a predetermined phase. Note that the "lock mechanism" is an example of a "projecting and retracting mechanism" in the scope of claims.

(Internal Rotor and Housing)

The internal rotor 3 is integrally installed at an edge of the camshaft 104. The camshaft 104 is rotatably installed on a cylinder head (not shown) in the engine 100.

The housing 2 includes a front plate 21 disposed on the side opposite to the side connected to the camshaft 104, a rear plate 23 that is integrally provided with a timing sprocket 23*a* and disposed on the side connected to the camshaft 104, and an external rotor 22. The external rotor 22 is provided to the outside of the internal rotor 3, and is sandwiched by the front plate 21 and the rear plate 23. The front plate 21, the external rotor 22, and the rear plate 23 are fastened by a bolt, and the housing 2 is thereby configured. The internal rotor 3 is capable of relative rotational movement with respect to the housing 2 within a fixed range.

Figure 2:
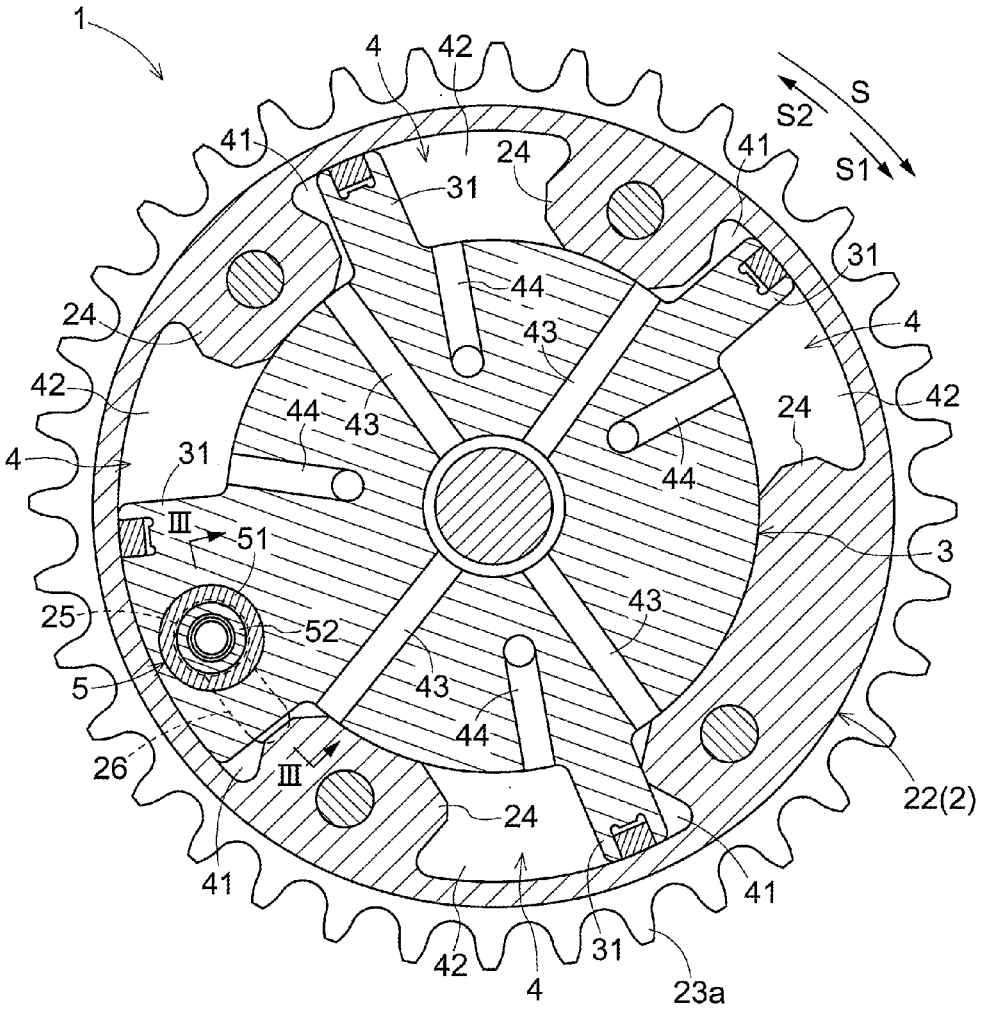
FIG. 2 is a cross-sectional view taken along line II-II in FIG. 1.

Upon the crankshaft 101 being driven to rotate, a rotational driving force thereof is transmitted to the timing sprocket 23*a* via a power transmission member 102, and the housing 2 is driven to rotate in a relative rotational direction S shown in FIG. 2. When the housing 2 is driven to rotate, the internal rotor 3 is driven to rotate in the relative rotational direction S to rotate the camshaft 104, and the cams provided on the camshaft 104 open and close the exhaust valves in the engine.

FIG. 2 shows a cross-sectional view taken along line II-II in FIG. 1. As shown in FIG. 2, the external rotor 22 has a plurality of projecting portions 24 that project toward the inside in the radial direction and are formed so as to be separate from each other in the relative rotational direction S. The projecting portions 24 and the internal rotor 3 form fluid pressure chambers 4. Although four fluid pressure chambers 4 are configured in the present embodiment, the number of fluid pressure chambers 4 is not limited thereto.

Projecting portions 31, each serving as a partitioning portion in the present invention, are formed so as to extend toward the outside in the radial direction on outer-circumferential portions of the internal rotor 3 that face the respective fluid pressure chambers 4. Each projecting portion 31 partitions, in the relative rotational direction S, the corresponding fluid pressure chamber 4 into an advance chamber 41 and a retard chamber 42.

Advance passages 43 are formed in the internal rotor 3, and the advance passages 43 are in communication with the advance chambers 41. Retard passages 44 are formed in the internal rotor 3, and the retard passages 44 are in communication with the retard chambers 42. As shown in FIG. 1, the advance passages 43 and the retard passages 44 are connected to a fluid supply and discharge mechanism 6, which will be described below.

The fluid supply and discharge mechanism 6 supplies or discharges a working fluid to or from the advance chambers 41 and the retard chambers 42, and exerts the fluid pressure of the working fluid on the projecting portions 31. The projecting portions 31 rotate due to the fluid pressure of the working fluid, thereby displacing the relative rotational phase of the internal rotor 3 with respect to the housing 2 in an advance direction S1 or a retard direction S2 shown in FIG. 2, or retaining the relative rotational phase of the internal rotor 3 at an arbitrary phase. The advance direction S1 refers to a direction in which the projecting portions 31 make relative rotational movement with respect to the housing 2, and the volume of the advance chambers 41 increases. The advance direction S1 is denoted by an arrow S1 in FIG. 2. The retard direction S2 refers to a direction in which the volume of the retard chambers 42 increases, and is denoted by an arrow S2 in FIG. 2.

The fixed range within which the housing 2 and the internal rotor 3 can make relative rotational movement, i.e., the phase difference between the most advanced phase and the most retarded phase corresponds to a range within which the projecting portions 31 can rotate within the fluid pressure chambers 4. The volume of the retard chambers 42 is largest at the most retarded phase, and the volume of the advance chambers 41 is largest at the most advanced phase. That is to say, the relative rotational phase changes between the most advanced phase and the most retarded phase.

As shown in FIG. 1, a torsion spring 103 is provided between the internal rotor 3 and the front plate 21. The relative rotational phase between the housing 2 and the internal rotor 3 is biased toward the retard direction S2 due to the biasing force of the torsion spring 103.

(Fluid Supply and Discharge Mechanism)

A configuration of the fluid supply and discharge mechanism 6 will be briefly described. As shown in FIG. 1, the fluid supply and discharge mechanism 6 includes a pump 61 that is driven by the engine 100 to supply the working fluid, a fluid passage switching valve 62 for controlling supply and discharge of the working fluid to and from the advance passages 43 and the retard passages 44, and an oil pan 63 for reserving the working fluid.

The pump 61 is a mechanical fluid pressure pump that is driven as a result of a rotational driving force of the crankshaft 101 being transmitted thereto. The pump 61 suctions the working fluid reserved in the oil pan 63 and discharges this working fluid downstream.

The fluid passage switching valve 62 operates based on control of the electricity supply amount performed by an ECU (engine control unit) 7. The fluid passage switching valve 62 performs control for switching an internal spool valve, thereby executing three types of operation, namely, supply of the working fluid to the advance chamber 41 and discharge of the working fluid from the retard chamber 42; discharge of the working fluid from the advance chamber 41 and supply of the working fluid to the retard chamber 42; and blocking of supply and discharge of the working fluid to and from the advance chamber 41 and the retard chamber 42.

The control for executing supply of the working fluid to the advance chamber 41 and discharge of the working fluid from the retard chamber 42 is "advance control". With the advance control, the projecting portions 31 make relative rotational movement with respect to the external rotor 22 in the advance direction S1, and the relative rotational phase changes toward the advance side. The control for executing discharge of the working fluid from the advance chamber 41 and supply of the working fluid to the retard chamber 42 is "retard control". With the retard control, the projecting portions 31 make relative rotational movement with respect to the external rotor 22 in the retard direction S2, and the relative rotational phase changes toward the retard side. With the control for blocking supply and discharge of the working fluid to and from the advance chamber 41 and the retard chamber 42, the projecting portions 31 are not caused to make relative rotational movement, and the relative rotational phase can be retained.

In the present embodiment, when electricity supply to the fluid passage switching valve 62 is turned "ON", the spool valve in the fluid passage switching valve 62 moves leftward in FIG. 1, and a working fluid passage that enables the retard control is formed. When electricity supply to the fluid passage switching valve 62 is turned "OFF", the spool valve in the fluid passage switching valve 62 moves rightward in FIG. 1, and a working fluid passage that enables the advance control is formed.

(Lock Mechanism)

Figure 3:
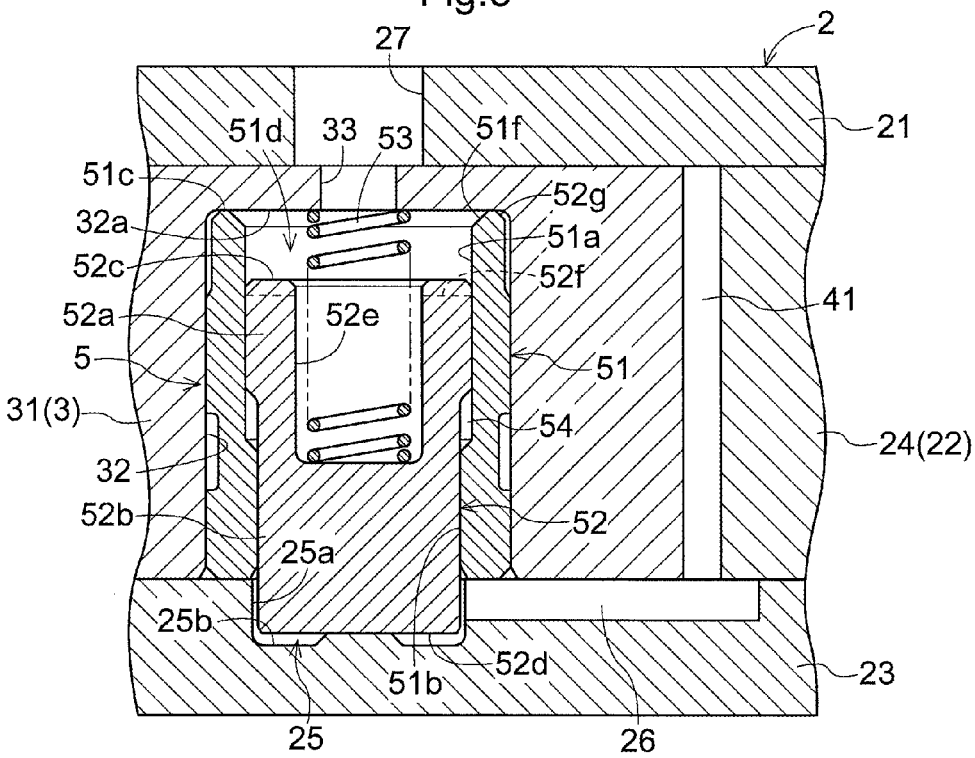
FIG. 3 is a cross-sectional view taken along line III-III in FIG. 2 in a locked state.
Figure 4:
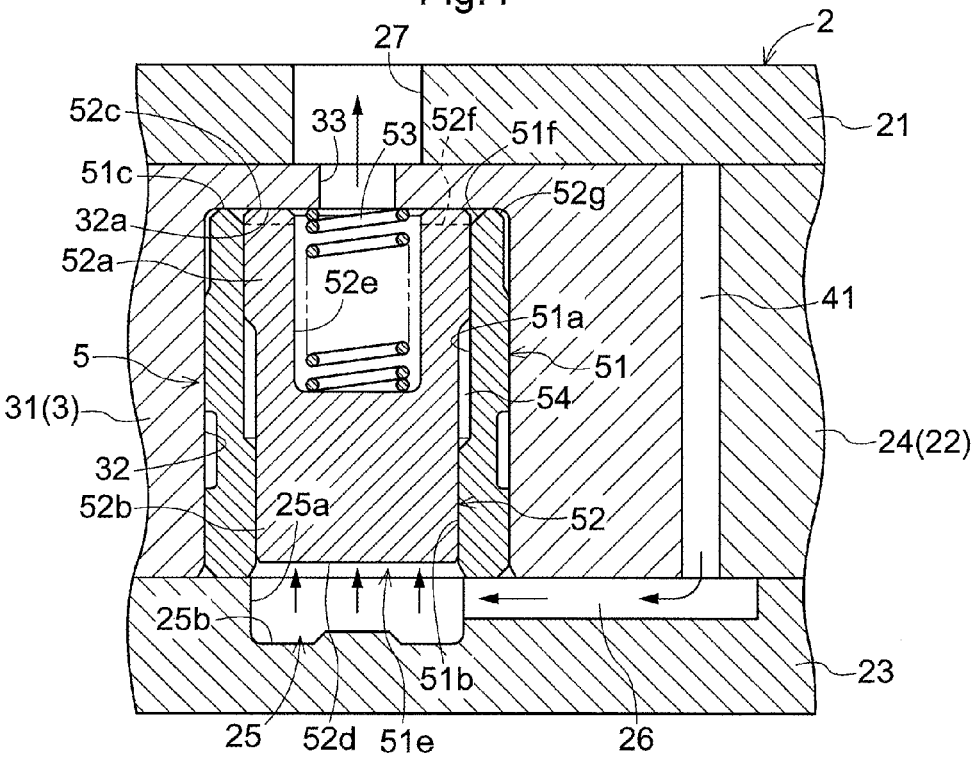
FIG. 4 is a cross-sectional view taken along line III-III in FIG. 2 in an unlocked state.
Figure 5:
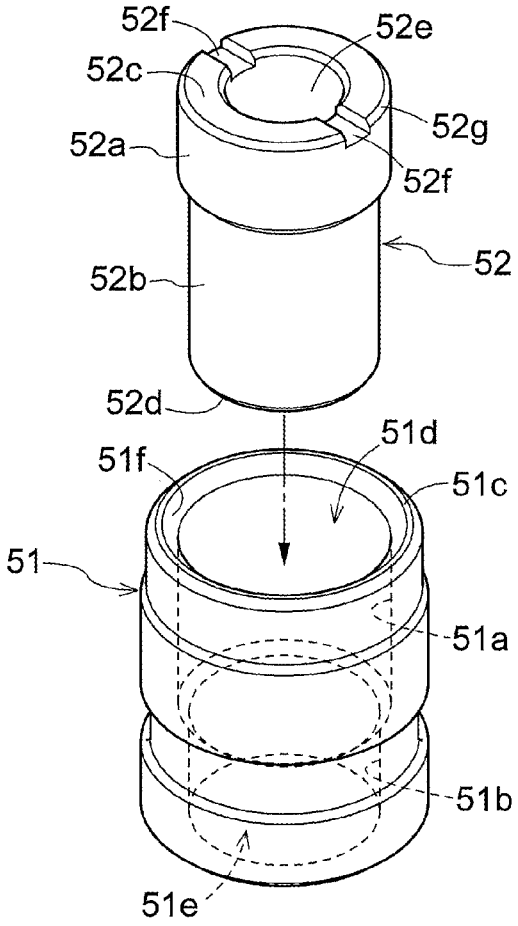
FIG. 5 is a perspective view showing a structure of a sleeve and a lock member.
Figure 6:
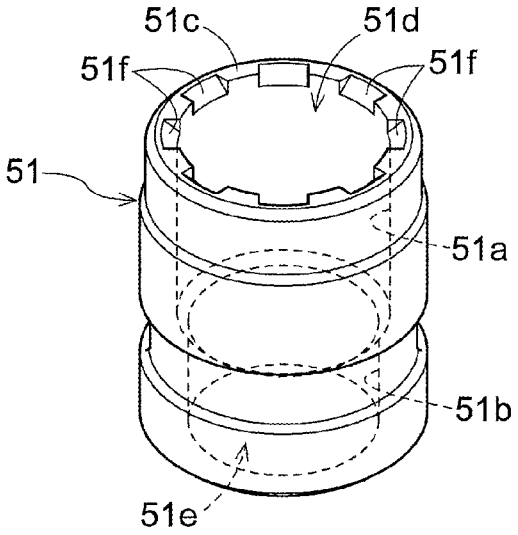
FIG. 6 is a perspective view showing another structure of the sleeve.

Next, the lock mechanism 5 will be described. FIG. 3 is a cross-sectional view taken along line III-III in FIG. 2 in a locked state, and FIG. 4 is a cross-sectional view taken along line III-III in FIG. 2 in an unlocked state. FIG. 5 is a perspective view showing a configuration of a sleeve 51 and a lock member 52. FIG. 6 shows a perspective view showing another configuration of the sleeve 51. The lock mechanism 5 is constituted by the sleeve 51, the lock member 52, a coil spring 53, and a lock hole 25. The sleeve 51, the lock member 52, and the coil spring 53 are installed in a hole portion 32 formed in each projecting portion 31 of the internal rotor 3. Note that the "lock member" is an example of a "projecting and retracting member" in the scope of claims, and the "lock hole" is an example of a "fitting hole" in the scope of claims.

The hole portion 32 is a bottomed hole that has a circular cross-section and is provided in a direction in which the lock member 52 projects and retracts (hereinafter referred to simply as a "projecting-retracting direction"), and is formed so as to extend from the rear plate 23 side of the internal rotor 3 toward the front plate 21. A first pressure exhaust hole 33, which is a through-hole having a circular cross-section, is opened from a sleeve-receiving surface 32*a*, which is the bottom surface of the hole portion 32, toward the front plate 21. The first pressure exhaust hole 33 has the same axis as that of the hole portion 32 and has a smaller diameter than the inner diameter of the hole portion 32. The hole portion 32 and the first pressure exhaust hole 33 are opened such that the axes of the hole portion 32 and the first pressure exhaust hole 33 are perpendicular to the front plate 21 and the rear plate 23.

The sleeve 51 is a cylindrical iron component pressed into the hole portion 32 and retained therein. Accordingly, the largest outer-circumferential diameter of the sleeve 51 is slightly larger than the inner diameter of the hole portion 32. The inner-circumferential side of the sleeve 51 is configured to have a shape formed by concentrically stacking a first hole 51*d* and a second hole 51*e* having a slightly smaller diameter than the inner diameter of the first hole 51*d*.

A corner at which a sleeve contact surface 51*c* and a first inner-circumferential surface 51*a* of the sleeve 51 intersect with each other has undergone C-chamfering or R-chamfering so as to have a larger chamfered surface than that obtained by usual chamfering, and a first chamfered surface 51*f* is thus formed. The size of the first chamfered surface 51*f* is about C0.3 to 1.0 or R0.5 to 2.0, for example. Note that C-chamfering includes not only 45-degree chamfering but also chamfering at other angles, e.g., 30-degree or 60-degree chamfering. The first chamfered surface 51*f* is not limited to a chamfered face that is continuously formed over the entire periphery of the corner shown in FIG. 5, and also includes a plurality of first chamfered surfaces 51*f* that are formed dispersedly in the circumferential direction shown in FIG. 6.

The lock member 52 is an iron component that is accommodated within the sleeve 51 and moves in the axial direction. The lock member 52 has a shape formed by stacking a first shaft portion 52*a* having a slightly smaller outer diameter than the inner diameter of the first inner-circumferential surface 51*a* of the sleeve 51 and a second shaft portion 52*b* having a slightly smaller outer diameter than the inner diameter of the second inner-circumferential surface 51*b*. A coil spring retaining hole 52*e* that is concentric with the first shaft portion 52*a* is formed so as to extend in the axial direction from a lock contact surface 52*c*, which is an end surface on the first shaft portion 52*a* side. Furthermore, the lock contact surface 52*c* has two communication grooves 52*f* formed so as to extend from the coil spring retaining hole 52*e* to the outside in the radial direction, at positions that are point-symmetric with respect to the axis of the lock contact surface 52*c*. Although two communication grooves 52*f* are provided in the present embodiment, the number of communication grooves 52*f* is not necessarily limited to two, and may be three or four. Meanwhile, it is preferable that the communication grooves 52*f* are formed in the circumferential direction at even intervals. An outer-circumferential corner at which the outer-circumferential surface of the first shaft portion 52*a* and the lock contact surface 52*c* intersect with each other has undergone C-chamfering or R-chamfering so as to have a larger chamfered surface than that obtained by normal chamfering, and a second chamfered surface 52*g* is thus formed. The second shaft portion 52*b* is fitted to the lock hole 25, which will be described later, in the locked state, and an end surface of the second shaft portion 52*b* serves as a pressure-receiving surface 52*d* for receiving the pressure of the working fluid. Note that in a state where the lock member 52 is accommodated in the sleeve 51, the first hole 51*d* faces the first shaft portion 52*a*, and the second hole 51*e* faces the second shaft portion 52*b*, as shown in FIGS. 3 and 4. At this time, the gap between the first hole 51*d* and the first shaft portion 52*a* is smaller than the gap between the second hole 51*e* and the second shaft portion 52*b*. With this configuration, the working fluid reserved in a space 54 formed by the first hole 51*d* and the second shaft portion 52*b* when the lock member 52 retracts from the lock hole 25 flows into the gap between the second hole 51*e* and the second shaft portion 52*b* when the lock member 52 projects toward the lock hole 25, and can thus lubricate a part of sliding surfaces of the lock member 52 and the sleeve 51.

The lock hole 25 is a circular bottomed hole formed on the internal rotor 3 side of the rear plate 23. The lock hole 25 includes a side portion 25*a* and a bottom portion 25*b*. The central region of the bottom portion 25*b* projects as compared with its surrounding region, in order to exert the fluid pressure of the working fluid on the pressure-receiving surface 52*d* of the lock member 52 even in the locked state. The inner diameter of the lock hole 25 is slightly larger than the outer diameter of the second shaft portion 52*b* such that the lock member 52 can project into the lock hole 25 and fitted thereto. The locked state is achieved when the lock member 52 is fitted to the lock hole 25, and the relative rotational movement of the internal rotor 3 with respect to the housing 2 is constrained. The unlocked state is achieved when the lock member 52 retracts from the lock hole 25, and the constraint on the relative rotational movement of the internal rotor 3 with respect to the housing 2 is cancelled. In the present embodiment, the lock hole 25 is formed at a position with which the locked state is achieved when the relative rotational phase achieved by the lock mechanism 5 is the most retarded phase. Furthermore, an unlocking passage 26 for causing the lock hole 25 and the advance chamber 41 to be in communication with each other is formed on the internal rotor 3 side of the rear plate 23.

(Installation of Lock Mechanism)

The lock mechanism 5 that is configured as described above is installed in the hole portion 32 of the internal rotor 3 as shown in FIGS. 3 and 4. The order of installation is as described below. Initially, the lock member 52 is inserted from the sleeve contact surface 51*c* side of the sleeve 51. Thereafter, the coil spring 53 is inserted in the coil spring retaining hole 52*e*, and this state is retained, while the sleeve 51 is pressed into the hole portion 32 until the sleeve contact surface 51*c* comes into contact with the sleeve-receiving surface 32*a*. Thus, installation is completed. At this time, since the coil spring 53 is retained at the bottom surface of the coil spring retaining hole 52*e* and the sleeve-receiving surface 32*a* in a state of being compressed from the natural length of the coil spring 53, the coil spring 53 applies a biasing force to the lock member 52 in a direction in which the lock member 52 projects from the internal rotor 3.

(Operation of Valve Timing Control Device)

Next, an operation of the valve timing control device 1 in the case where the engine is started with the relative rotational phase being the most retarded phase will be described. In a state where the engine 100 is stopped, the pump 61 is stopped. Electricity supply to the fluid passage switching valve 62 is in an "OFF" state, and the working fluid passage that enables the advance control is formed. Accordingly, the working fluid is not supplied to the lock mechanism 5. At this time, as shown in FIG. 3, the lock member 52 projects due to the biasing force of the coil spring 53 and is fitted to the lock hole 25, and the relative rotational phase is in a state of being constrained at the most retarded phase by the lock mechanism 5.

Upon the engine 100 starting, the pump 61 is activated. Electricity supply to the fluid passage switching valve 62 remains in an "OFF" state, and the working fluid passage that enables the advance control is formed. For this reason, due to the advance control, the working fluid is supplied to the advance chamber 41 from the fluid supply and discharge mechanism 6 via the advance passage 43. At this time, the working fluid is also supplied to the lock hole 25 via the unlocking passage 26, and the fluid pressure of the working fluid is exerted on the pressure-receiving surface 52*d* of the lock member 52. The biasing force of the coil spring 53 is set to be smaller than the fluid pressure exerted on the pressure-receiving surface 52*d*. For this reason, the lock member 52 begins to retract from the lock hole 25 due to the fluid pressure exerted on the pressure-receiving surface 52*d*, and the lock member 52 retracts from the lock hole 25 until the lock contact surface 52*c* comes into contact with the sleeve-receiving surface 32*a*. The constraint placed by the lock mechanism 5 is thereby cancelled, and the unlocked state shown in FIG. 4 is achieved. In the unlocked state, the lock contact surface 52*c* of the lock member 52 is in surface contact with the sleeve-receiving surface 32*a* of the internal rotor 3. Thus, since the lock contact surface 52*c* and the sleeve-receiving surface 32*a* are in contact in a relatively wide area, a stress exerted on the lock contact surface 52*c* and the sleeve-receiving surface 32*a* at the time of contact is small. For this reason, even if the lock contact surface 52*c* and the sleeve-receiving surface 32*a* are repeatedly brought into contact due to retraction of the lock member 52, a deformation or abrasion does not occur on the surfaces of the lock contact surface 52*c* and the sleeve-receiving surface 32*a*, and the valve timing control device 1 can maintain excellent performance for a long period of time.

While the engine 100 is running, the advance control and the retard control are performed by the ECU 7 in order to achieve an appropriate relative rotational phase within the range from the most advanced phase to the most retarded phase, in accordance with the number of revolutions of the engine 100 and the load thereon. With the advance control, the working fluid is supplied to the advance chamber 41, and the working fluid in the retard chamber 42 is discharged. On the contrary, with the retard control, the working fluid is supplied to the retard chamber 42, and the working fluid in the advance chamber 41 is discharged. Thus, the relative rotational phase between the housing 2 and the internal rotor 3 changes.

During the advance control, the lock contact surface 52*c* of the lock member 52 is in contact with the sleeve-receiving surface 32*a* due to the fluid pressure exerted on the pressure-receiving surface 52*d*. However, during the retard control, the working fluid is discharged from the advance chamber 41 and is supplied to the retard chamber 42, and accordingly, the fluid pressure is not exerted on the pressure-receiving surface 52*d*. For this reason, the lock member 52 is brought into a state of being in contact with the surface of the rear plate 23 on the internal rotor 3 side due to the biasing force of the coil spring 53. However, since the working fluid is attached to the pressure-receiving surface 52*d* and the rear plate 23, the pressure-receiving surface 52*d* and the rear plate 23 will not be worn even if rotational movement is made in this state.

Upon the engine 100 being stopped, the fluid supply and discharge mechanism 6 is also stopped, and the working fluid is discharged from both the advance chamber 41 and the retard chamber 42. Then, the relative rotational phase becomes the most retarded phase due to the biasing force of the torsion spring 103, the lock member 52 projects into the lock hole 25 due to the biasing force of the coil spring 53 and is fitted to the lock hole 25, and the locked state shown in FIG. 3 is achieved. Thus, the relative rotational phase is constrained at the most retarded phase in order to prepare for next engine start.

(Projecting and Retracting Operation of Lock Member)

As described above, the advance control and the retard control are performed while the engine 100 is running, and the working fluid is supplied to and discharged from the advance chamber 41 and the retard chamber 42. The supplied working fluid permeates the inside of the lock mechanism 5 through the gap between the front plate 21 and the internal rotor, the gap between the rear plate 23 and the internal rotor, the unlocking passage 26, and the like. Accordingly, in the locked state where the engine 100 is stopped, the space constituted by the sleeve-receiving surface 32*a*, the first inner-circumferential surface 51*a*, the lock contact surface 52*c*, the coil spring retaining hole 52*e*, and the like is filled with the working fluid. The space constituted by the pressure-receiving surface 52*d* and the lock hole 25 is also filled with the working fluid.

When the engine 100 is started and the advance control is performed, the lock member 52 retracts from the lock hole 25, and the lock contact surface 52*c* and the sleeve-receiving surface 32*a* come into contact with each other. At this time, the working fluid that fills the space constituted by the sleeve-receiving surface 32*a*, the first inner-circumferential surface 51*a*, the lock contact surface 52*c*, the coil spring retaining hole 52*e*, and the like is discharged to the outside of the valve timing control device 1 through the first pressure exhaust hole 33 and a second pressure exhaust hole 27 that is formed in the front plate and in communication with the first pressure exhaust hole 33, and the discharged working fluid is reserved in the oil pan 63. However, not all working fluid is discharged. A fluid film of the working fluid is present between the lock contact surface 52*c* and the sleeve-receiving surface 32*a*, and the working fluid remains in a space having a ring shape (hereinafter referred to as a "ring-like space") constituted by the first chamfered surface 51*f*, the second chamfered surface 52*g*, and the sleeve-receiving surface 32*a*. Furthermore, the working fluid also remains in the communication groove 52*f* and the coil spring retaining hole 52*e*.

As described above, upon the engine 100 being stopped, the relative rotational phase becomes the most retarded phase, and the lock member 52 projects into the lock hole 25 due to the biasing force of the coil spring 53 and is fitted to the lock hole 25. Upon the lock member 52 beginning to project, the gap between the lock contact surface 52*c* and the sleeve-receiving surface 32*a* increases, while the working fluid remaining in the ring-like space, the communication groove 52*f*, and the coil spring retaining hole 52*e* permeates the increased gap, thus a reduction in the pressure of the fluid film is suppressed, and furthermore, the linking force is reduced. This is because the working fluid permeates the increased gap from every direction, and the working fluid spreads throughout the lock contact surface 52*c* in a short time. Specifically, the working fluid in the ring-like space permeates from the outside of the lock member 52, and the working fluid in the coil spring retaining hole 52*e* permeates from the inside of the lock member 52. Furthermore, the working fluid in the communication groove 52*f* permeates from an intermediate portion between the outside and the inside of the lock member 52. Furthermore, since the communication groove 52*f* causes the working fluid remaining in the coil spring retaining hole 52*e* and the working fluid remaining in the ring-like space to be in communication with each other, even if the working fluid in the ring-like space decreases due to permeation of the working fluid in the ring-like space into the gap between the lock contact surface 52*c* and the sleeve-receiving surface 32*a*, the working fluid in the coil spring retaining hole 52*e* can be supplied to the ring-like space through the communication groove 52*f*.

Accordingly, when the engine 100 is stopped, a temporal delay does not occur when the lock member 52 begins to move so as to project into the lock hole 25 due to the biasing force of the coil spring 53, and the performance and operation of the valve timing control device 1 can be realized as designed.

Figure 7:
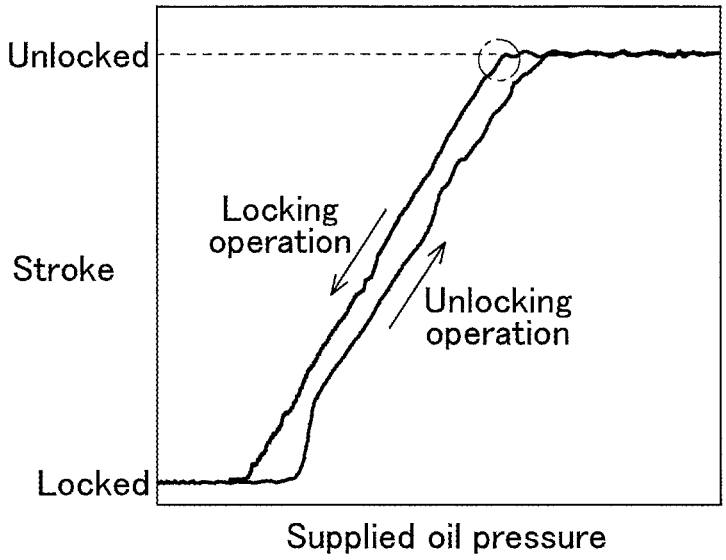
FIG. 7 is a graph showing a relationship between the fluid pressure of a working fluid exerted on a pressure-receiving surface of the lock member and the stroke of the lock member when a sleeve having a first chamfered surface is used.
Figure 8:
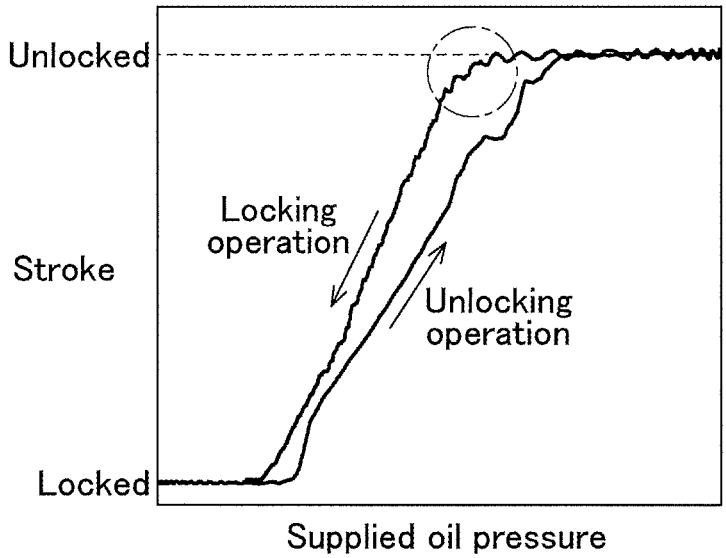
FIG. 8 is a graph showing a relationship between the fluid pressure of a working fluid exerted on the pressure-receiving surface of the lock member and the stroke of the lock member when a sleeve that does not have the first chamfered surface is used.

FIG. 7 is a graph showing a relationship between the fluid pressure of the working fluid supplied to the advance chamber 41 and the stroke of the lock member 52 when the sleeve 51 having the first chamfered surface 51*f* is used, i.e., when the amount of the working fluid remaining in the ring-like space is large. FIG. 8 is a graph showing a relationship between the fluid pressure of the working fluid supplied to the advance chamber 41 and the stroke of the lock member 52 when a sleeve that does not have the first chamfered surface 51*f* is used, i.e., when little working fluid is in the ring-like space. In FIGS. 7 and 8, the manner of movement of the lock member 52 at the initial stage of the locking operation is different as shown in the portions enclosed by alternate long and short dash lines.

In FIG. 7, at the initial stage of the locking operation, the lock member 52 begins to move when the fluid pressure becomes smaller than a predetermined supplied fluid pressure, and the stroke of the lock member 52 decreases in proportion to the decreased amount of the fluid pressure. This indicates that the lock member 52 is moving in a state where the fluid pressure exerted on the pressure-receiving surface 52*d* is balanced with the biasing force of the coil spring 53, i.e., that the movement of the lock member 52 is not affected by the linking force. However, in FIG. 8, the lock member 52 does not immediately move when the fluid pressure becomes smaller than the predetermined supplied fluid pressure, and even when the lock member 52 moves, the movement is not in proportion to the decreased amount of the fluid pressure. As compared with FIG. 7, it can be found that the initial operation of the lock member 52 is slow. When the fluid pressure is further reduced and the gap between the lock contact surface 52*c* and the sleeve-receiving surface 32*a* increases (i.e., when the stroke decreases), the lock member 52 moves in proportion to the decreased amount of the fluid pressure as in FIG. 7. This indicates that the lock member 52 in FIG. 8 is affected by the linking force generated between the lock contact surface 52*c* and the sleeve-receiving surface 32*a* in the initial stage of the operation, and is not affected by the linking force after the gap increases. Accordingly, the lock member 52 can be operated without being affected by the linking force, as a result of forming the first chamfered surface 51*f* on the sleeve 51 such that a large amount of the working fluid remains in the ring-like space.

Although the present embodiment has described only the application to a lock mechanism, the valve timing control device according to the present invention is also applicable to a restriction mechanism for restricting the relative rotational phase of a driven-side rotational member with respect to a driving-side rotational member within a predetermined range.

The valve timing control device according to the present invention may also be applied to an exhaust-side valve timing control device.

INDUSTRIAL APPLICABILITY

The present invention is applicable to a valve timing control device for controlling a relative rotational phase of a driven-side rotational member with respect to a driving-side rotational member that rotates synchronously with a crankshaft in an internal combustion engine.

REFERENCE SIGNS LIST

1 Valve timing control device
2 Housing (driving-side rotational member)
3 Internal rotor (driven-side rotational member)
4 Fluid pressure chamber
5 Lock mechanism (projecting and retracting mechanism)
25 Lock hole (fitting hole)
31 Projecting portion (partitioning portion)
32 Hole portion
51 Sleeve
51*d* First hole
51*e* Second hole
51*f* First chamfered surface
52 Lock member (projecting and retracting member)

52*a* First shaft portion
52*b* Second shaft portion
52*g* Second chamfered surface
100 Engine (internal combustion engine)
101 Crankshaft
104 Camshaft

The invention claimed is:

1. A valve timing control device comprising:

a driving-side rotational member rotating synchronously with a crankshaft in an internal combustion engine;

a driven-side rotational member disposed coaxially with the driving-side rotational member and rotating synchronously with a camshaft for opening and closing a valve in the internal combustion engine;

a fluid pressure chamber formed by the driving-side rotational member and the driven-side rotational member;

a partitioning portion provided in at least one of the driving-side rotational member and the driven-side rotational member so as to partition the fluid pressure chamber into an advance chamber and a retard chamber; and a projecting and retracting mechanism having a hole portion formed in one of the driving-side rotational member and the driven-side rotational member, a cylindrical sleeve accommodated in the hole portion, a projecting and retracting member accommodated in the sleeve and capable of projecting and retracting with respect to the other of the driving-side rotational member and the driven-side rotational member, and a fitting hole formed in the other of the driving-side rotational member and the driven-side rotational member such that the projecting and retracting member can be fitted to the fitting hole when the projecting and retracting member projects, the projecting and retracting mechanism constraining a relative rotational phase of the driven-side rotational member with respect to the driving-side rotational member at a predetermined phase when the projecting and retracting member is fitted to the fitting hole, wherein when the projecting and retracting member retracts from the fitting hole, an end face of the projecting and retracting member on a side opposite to a side facing the fitting hole comes into surface contact with a bottom surface of the hole portion, and a plurality of first chamfered surfaces is formed dispersedly in a circumferential direction at an inner-circumferential corner of an end of the sleeve on a side opposite to a side facing the fitting hole.

2. The valve timing control device according to claim 1, wherein a second chamfered surface is formed in a circumferential direction at an outer-circumferential corner of an end of the projecting and retracting member on a side opposite to a side facing the fitting hole.

3. The valve timing control device according to claim 1, wherein the sleeve is configured in a shape formed by concentrically stacking a first hole and a second hole whose diameter is smaller than the diameter of the first hole, on an inner-circumferential side of the sleeve, the projecting and retracting member has, on an outer-circumferential side thereof, a first shaft portion whose outer diameter is smaller than the inner diameter of the first hole, and a second shaft portion whose outer diameter is smaller than the inner diameter of the second hole, the inner circumference of the first hole faces the outer circumference of the first shaft portion, and the inner circumference of the second hole faces the outer circumference of the second shaft portion, in a state where the projecting and retracting member is accommodated in the sleeve, and a gap between the first hole and the first shaft portion is smaller than a gap between the second hole and the second shaft portion.

4. The valve timing control device according to claim 1, wherein when the projecting and retracting member retracts from the fitting hole, a ring-like space is formed by the plurality of first chamfered surfaces, the bottom surface of the hole portion, and an outer-circumferential surface of the projecting and retracting member.

* * * * *